US005895061A

United States Patent [19]

Gignoux

[11] Patent Number: 5,895,061

[45] Date of Patent: Apr. 20, 1999

[54] IN-LINE ROLLER SKATE WITH REMOVABLE BOOT

[75] Inventor: Pierre Gignoux, Coublevie, France

[73] Assignee: Skis Rossignol S.A., Voiron, France

[21] Appl. No.: 08/993,379

[22] Filed: Dec. 18, 1997

[30] Foreign Application Priority Data

Dec. 31, 1996 [FR] France ..... 96 16388

[51] Int. Cl.[6] ..... A63C 17/14

[52] U.S. Cl. ..... 280/11.2; 280/11.19; 280/11.22; 280/11.27

[58] Field of Search ..... 280/11.2, 11.19, 280/11.22, 11.27

[56] References Cited

U.S. PATENT DOCUMENTS

| | | | |
|---|---|---|---|
| 5,211,409 | 5/1993 | Mitchell et al. | 280/11.2 |
| 5,435,579 | 7/1995 | Pozzobon | 280/11.2 |
| 5,462,296 | 10/1995 | Pozzobon | 280/11.2 |
| 5,590,889 | 1/1997 | Pozzobon | 280/11.2 |
| 5,630,595 | 5/1997 | Perner | 280/11.2 |
| 5,664,794 | 9/1997 | Mitchell et al. | 280/11.2 |
| 5,755,449 | 5/1998 | Pozzobon | 280/11.2 |

FOREIGN PATENT DOCUMENTS

| | | | |
|---|---|---|---|
| 0 56 88 78 A1 | 11/1993 | European Pat. Off. . | |
| 0 70 56 26 A2 | 4/1996 | European Pat. Off. . | |
| WO93/20912 | 10/1993 | WIPO | 280/11.2 |

*Primary Examiner*—D. Glenn Dayoan
*Assistant Examiner*—Clovia Hamilton
*Attorney, Agent, or Firm*—Kane, Dalsimer, Sullivan, Kurucz, Levy, Eisele and Richard, LLP

[57] ABSTRACT

Skate comprising a chassis (1) equipped with rollers (2, 3, 4, 5), a boot (6) attached removably to this chassis and a brake (9) operated by bending of the leg via a lever (11) articulated to the chassis and having, at the back, an operating rod (14) which is placed facing a buffer (16) of the boot when the boot is secured to the chassis.

3 Claims, 3 Drawing Sheets

IN-LINE ROLLER SKATE WITH REMOVABLE BOOT

FIELD OF THE INVENTION

The present invention relates to a roller skate comprising a chassis equipped with rollers, a boot attached removably to this chassis by binding means, and a brake operated by bending of the leg via a lever articulated to the chassis.

PRIOR ART

Such skates are known from patents U.S. Pat. Nos. 920,848, 926,646 and 1,402,010, the brake lever in this third embodiment not, however, being articulated directly to the chassis but to a part of the boot binding. In all three embodiments, the brake lever is attached to the leg by means of a cuff or strap. This means that each time the boot is secured to the chassis or detached from the chassis, the cuff or strap has to be attached to, or respectively detached from, the leg.

All such operations were acceptable in these old skates, where securing the boot to the chassis in any case required the securing of straps, but they become tiresome in a skate comprising automatic means of securing the boot to the chassis, like those developed by the applicant.

SUMMARY OF THE INVENTION

The object of the present invention is precisely to do away with any operation of attaching the brake lever to the boot or to the leg.

To this end, the roller skate according to the invention is one wherein the brake lever has, at the back, an operating rod which rises up more or less parallel to the back of the boot and wherein the boot has, at the back, a buffer which fits over the end of the rod when the boot is secured to the chassis so that the brake lever can be operated against the action of a spring for returning the lever to the inactive position.

For positioning the end of the rod against the buffer, the latter preferably has a recess of approximately conical shape, in which the rod is guided and positioned when the boot is secured.

The brake may be a block brake acting on the ground or a brake that acts on the rear roller or on the rear two rollers.

BRIEF DESCRIPTION OF THE DRAWINGS

The appended drawing depicts, by way of example, two embodiments of the invention.

DESCRIPTION OF THE PREFERRED EMBODIMENT(S)

Figure 1:
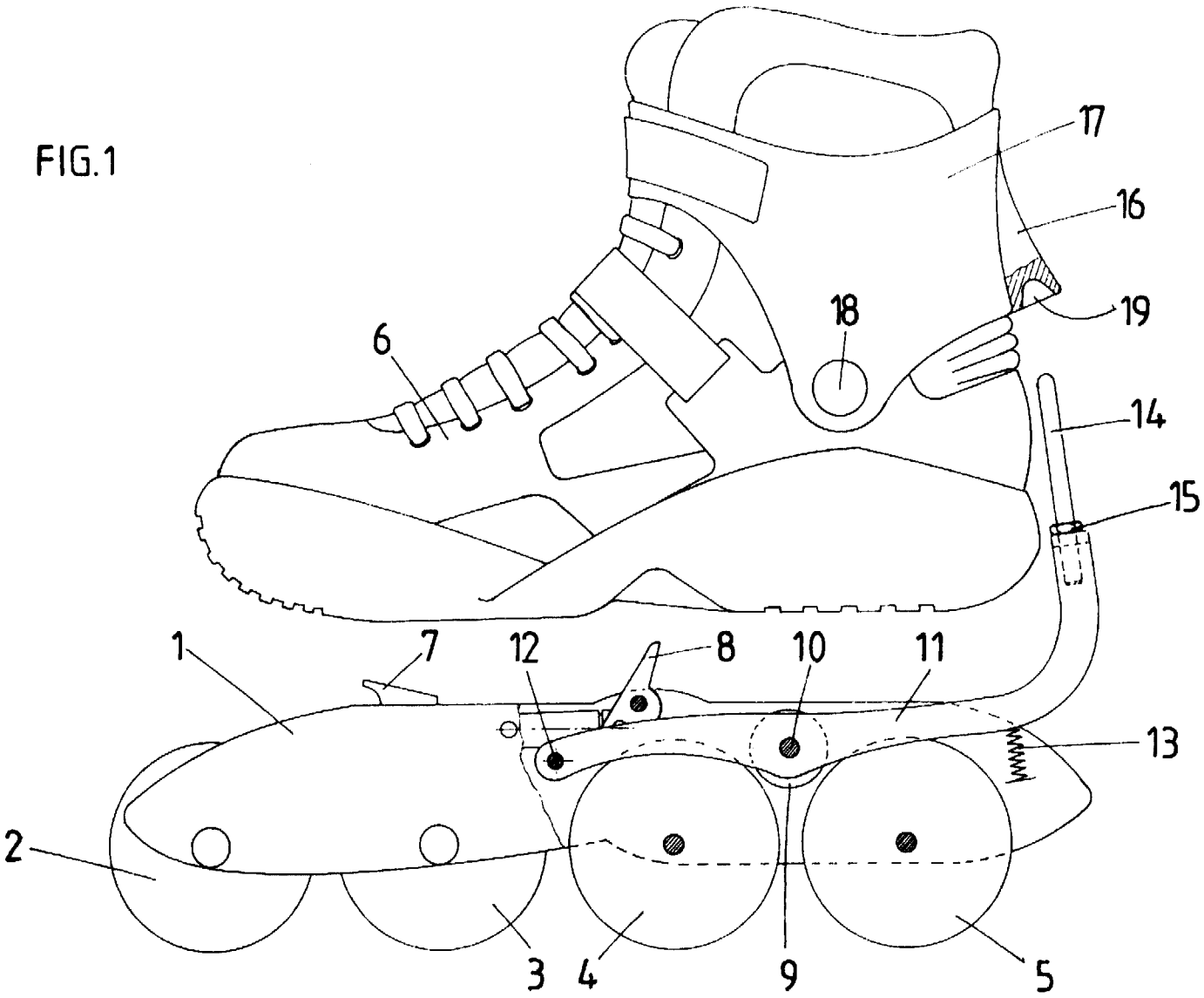
FIG. 1 depicts a first embodiment, with the boot separate from the skate.

FIG. 1 depicts a chassis 1 equipped with four rollers, 2, 3, 4, 5 in a line and means of automatically securing a boot 6. These binding means essentially consist of a stationary hook 7 at the front and a latch 8 in the form of a pedal articulated to the chassis 1 and which locks in the folded-down position using a latch lock articulation mechanism, as described in the parallel U.S. patent application Ser. No. 08/927,835, when the boot 6 presses down on the chassis 1.

The skate also comprises a brake which consists of a pair of disks 9 mounted so that they can rotate and move axially on an axle 10 between the two parallel arms of a lever 11 carrying the axle 10 and articulated to the chassis about an axle 12, in front of the third roller 4. The disks 9 have a frustoconical face facing the rollers and they are held away from the rollers 4 and 5 by a spring 13 working in compression and pushing the lever 11 back upward. Behind the chassis 1, the two arms of the lever 11 are curved and joined together. At the point where they connect, the lever 11 is extended by an upwardly-directed rod 14 extending more or less parallel to the back of the boot 6. This rod 14 is screwed by a threaded part into the lever 11 and locked at the desired height by a nut 15.

The sole of the boot 6 is equipped with catching means for complementing the hook 7 and the latch 8. At the rear, the boot 6 has a buffer 16 fixed to the back of a cuff 17 articulated to the boot about an axle 18 in the malleolar region and intended to be tightened around the ankle. The buffer 16 has a conical recess 19 which is open downward.

The boot 6 is secured to the chassis 1 by engaging the hook 7 in the corresponding catching means of the front part of the boot, then pressing down on the latch 8, as described in patent application FR 96/11345. During this operation, the end of the rod 14 engages of its own accord in the recess 19 of the buffer 16. The protruding length of the rod 14 is adjusted in such a way that the end of the rod 14 is approximately in contact with the closed end of the recess 19 when the skater is in a position of rest.

Braking takes place in the conventional way with advancement of the skate, which has the effect of making the cuff 17 pivot backward and of operating the lever 11. The disks 9 therefore come into contact, via their frustoconical faces, with the rollers 4 and 5 and are moved apart and pressed against the arms of the lever 11 in the way described in the publication EP No 0 763 373.

Figure 2:
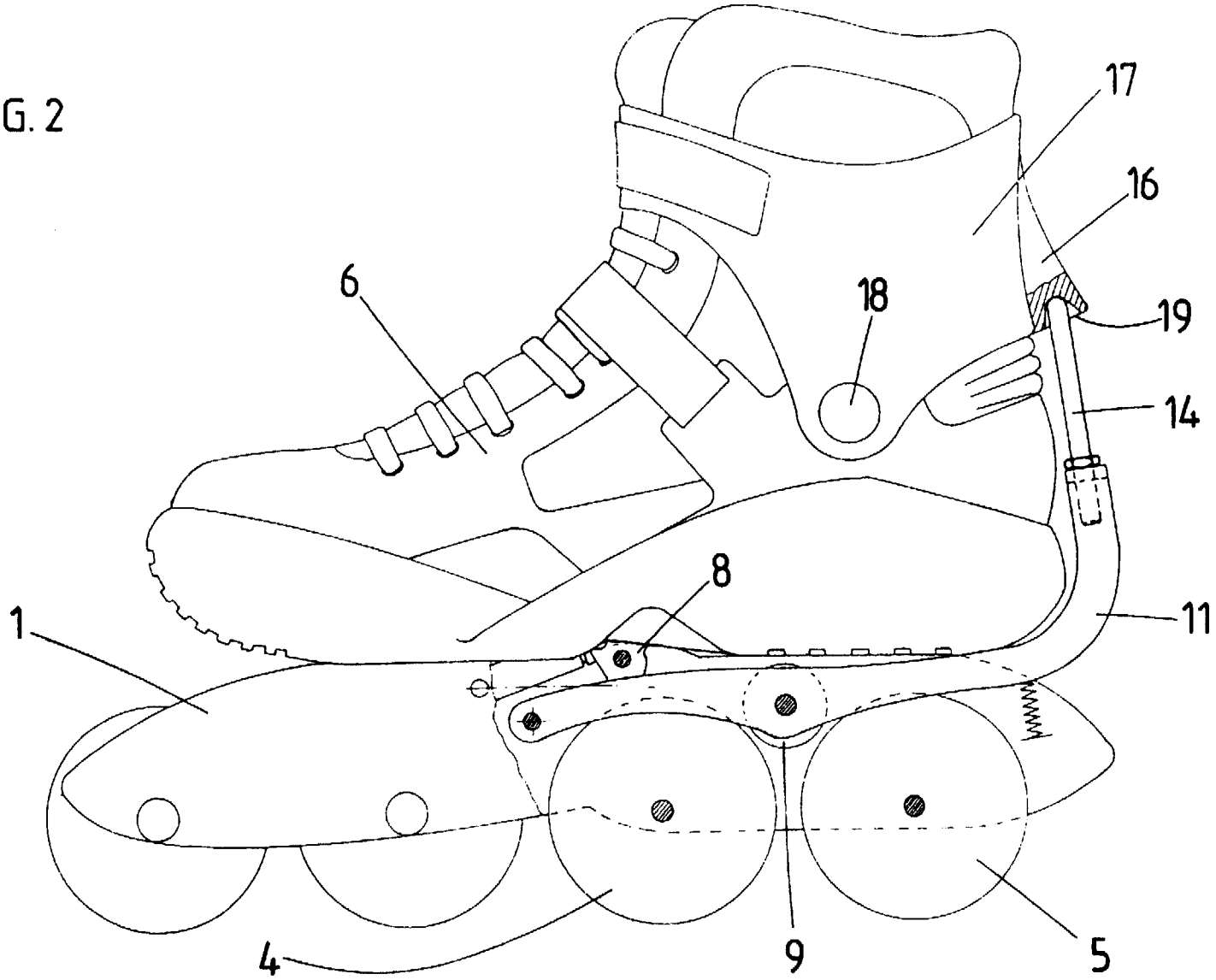
FIG. 2 depicts the same embodiment after the boot has been secured to the skate.
Figure 3:
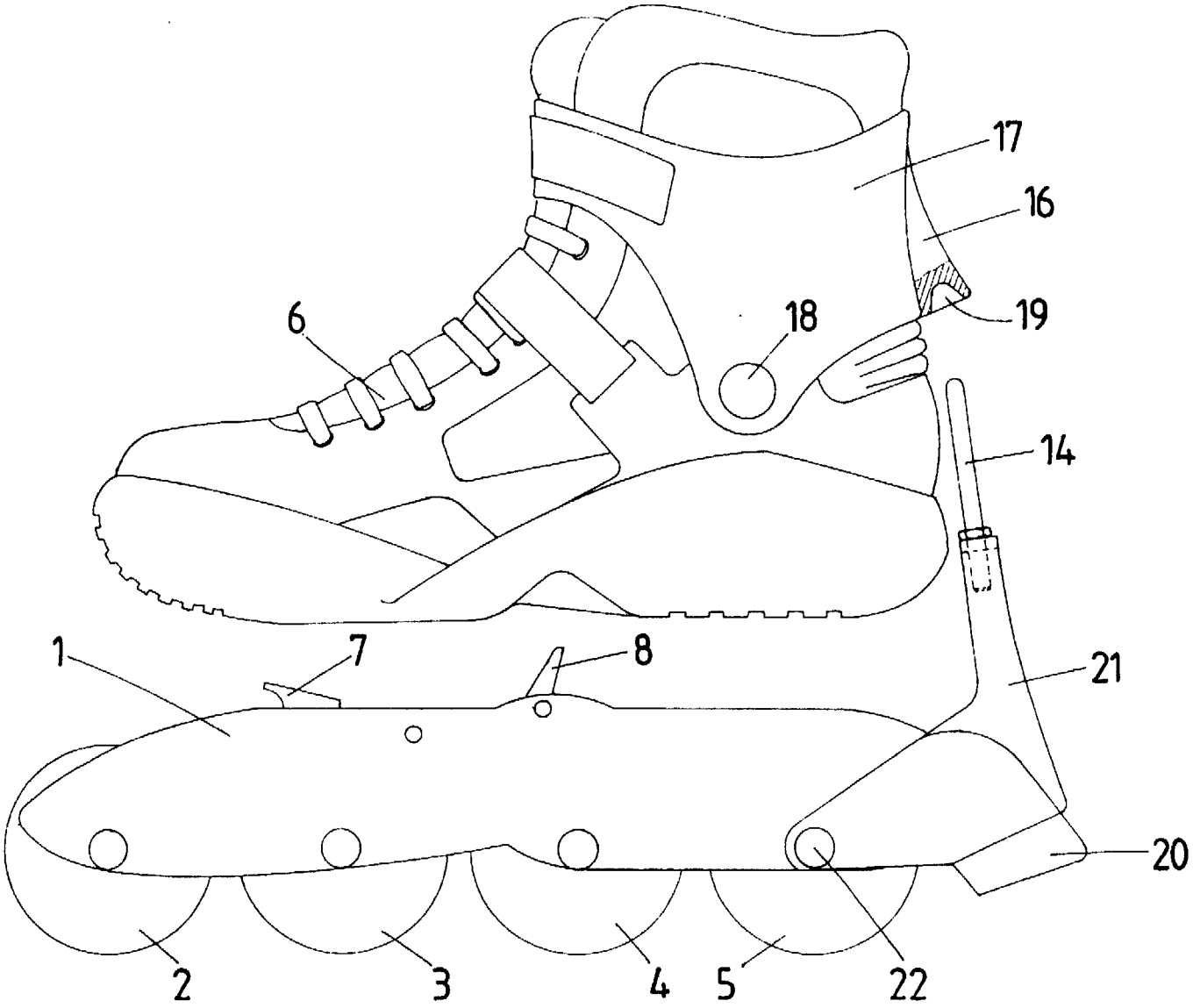
FIG. 3 depicts a second embodiment.

The second embodiment depicted in FIG. 3 differs from the first embodiment only in the type of brake. In the second embodiment, the brake consists of a block of rubber 20 intended to brake against the ground behind the skate. This block is mounted on a lever 21 articulated to the axle 22 of the roller 5. In all other respects, the skate depicted in FIG. 3 is identical to the one depicted in FIGS. 1 and 2.

The buffer 16 and the end of the rod 14 could have any other shape designed to prevent the rod 14 from escaping from the buffer 16. This could be achieved using dentelated surfaces.

In an alternative embodiment, not depicted, the buffer 16 and the rod 14 are shaped in such a way that they snap-fasten together, it being possible for a push-button or some other member to be provided for freeing the rod 14.

I claim:

1. A roller skate comprising a chassis (1) equipped with rollers (2, 3, 4, 5) a boot (6) attached removably to this chassis by boot binding means (7, 8) for attaching the boot to the chassis, and a brake (9; 20) operated by bending of the leg via a lever (11; 21) articulated to the chassis, wherein the brake lever has, at the back, an operating rod (14) which rises up more or less parallel to the back of the boot and wherein the boot has, at the back, a buffer (16) which fits over the end of the rod when the boot is secured to the chassis so that the brake lever can be operated against the action of a spring (13), the buffer (16) having a recess of at least approximately conical shape, in which the rod (14) is guided and positioned when the boot is secured to the chassis.

2. A roller skate for a boot having a leg, back and a sole, the skate comprising a chassis equipped with rollers, first parts of a boot binding means for attaching the boot to the chassis and with a spring biased brake lever articulated on the chassis and extended by a driving rod rising up substantially parallel to the back of the boot, a boot removable attached to the chassis with a sole equipped with second parts of said boot binding means and a boot leg capable of tilting backward relatively to the sole, the boot leg having, at the back, a buffer which fits over the end of said rod serving as an extension of the rod when the boot is attached to the chassis by said boot binding means.

3. The roller skate as claimed in claim 2, wherein said buffer has a guiding recess guiding and receiving the end of the rod.

* * * * *